United States Patent [19]

Bilanzich

[11] 4,202,052

[45] May 13, 1980

[54] EXTENDABLE INFANT SHEET AND SLEEPER

[76] Inventor: Lydia K. Bilanzich, 4575 Willow Rd., Salt Lake City, Utah 84117

[21] Appl. No.: 908,534

[22] Filed: May 22, 1978

[51] Int. Cl.[2] ..... A47G 9/00

[52] U.S. Cl. ..... 2/69.5; 5/498; 5/416; 2/114

[58] Field of Search ..... 5/92, 317, 334 R, 336, 5/343, 344; 2/69.5, 114

[56] References Cited

U.S. PATENT DOCUMENTS

| | | | |
|---|---|---|---|
| 2,451,807 | 10/1948 | Catizone | 2/114 |
| 2,851,703 | 9/1958 | Greco | 5/334 C |
| 3,273,175 | 7/1966 | Anderson et al. | 5/334 C |
| 3,845,513 | 11/1974 | Hubner | 2/69.5 |

*Primary Examiner*—Casmir A. Nunberg
*Attorney, Agent, or Firm*—Thorpe, North & Gold

[57] ABSTRACT

A crib sheet for retaining an infant in a central region of a crib or bed and preventing such an infant from displacing a blanket covering when unattended. The sheet includes a central pleat which extends along the entire sheet length and is sewed or otherwise fixed in a folded configuration at the ends thereof. A sleeper jacket is attached at an opening across the central pleat to form an integral sleeper unit. The extendable pleat between the fixed ends permits safe movement for the infant without binding the sheet or causing other discomfort.

8 Claims, 3 Drawing Figures

EXTENDABLE INFANT SHEET AND SLEEPER

BACKGROUND OF THE INVENTION

1. Field of the Invention

This invention relates to infant sheets for a crib or bed, and more particularly to an infant sheet adapted for attachment of a jacket or other form of infant retaining clothing.

2. Prior Art

Numerous solutions have been presented in the past to develop a crib or bed covering which holds an infant in place and prevents him from kicking or otherwise displacing a blanket or similar form of covering while unattended. U.S. Pat. Nos. 2,030,091; 2,439,101; 1,403,873; 1,079,798; and 2,465,062 illustrate various forms of sheets or blankets which are secured at the lower part of the bed or crib and have an attached sleeper or infant garment which, in common, retain the infant in a central region of a crib or bed. Although helpful, none of the disclosed embodiments presents a fully effective method for keeping the infant covered when unattended. In addition, many of these suggested solutions were easy for the infant to loosen from the bed or crib, and would sometimes present a risk of entanglement which might be harmful, as well as uncomfortable.

U.S. Pat. No. 1,802,540 suggested a full length covering as more suitable to prevent the infant from becoming uncovered, but did not overcome the potential risks previously described. U.S. Pat. Nos. 2,419,989 and 2,451,807 disclose infant garments having improved characteristics in some respects; however, the disclosed garments still retain reduced mobility and loss of warmth to the infant. For example, in both configurations the covering is open at the back, permitting air flow under the sheet, particularly when the infant is turned on its side or is laying toward its front. Also, the taut configuration of the upper portion of the sheet upon which the trunk section of the infant's body rests during sleep does not provide free movement when the infant is playing or sitting in the crib or bed. Furthermore, both of the latter configurations represent expensive manufacturing processes and involve some inconvenience in use.

OBJECTS AND SUMMARY OF THE INVENTION

It is therefore an object of the present invention to provide an infant sheet which is adapted for use with a crib or bed to retain an infant in the central portion of such crib or bed while not restricting the infant's movement or comfort.

It is a further object of the present invention to provide such an infant sheet which is adapted for use with an attached jacket which totally encloses the infant's torso and prevents air currents from flowing underneath the covering.

An additional object of the present invention is to adapt an infant sheet which permits full extension the length of the sheet to provide improved movement capability for the infant.

An additional object of this invention is to provide an infant sheet which provides minimal cost in manufacture and can be secured to the crib or bed with ease.

A still further object of the present invention is to adapt such an infant sheet with means for preventing release of the sheet from a mattress foundation.

These and other objects are realized in an infant sheet which includes a sheet member of length greater than the length of a mattress to which it is to be applied, which sheet member has a central pleat formed along the length thereof. This central pleat traverses the central length of the sheet member and is fixed at the respective ends to prevent extension of the pleat thereat and thereby maintain a disposition to a folded configuration along substantially the full length thereof. The central section of the central pleat is not fixed, but is extendable such that an infant can lay underneath the sheet or sit up and move about without having to overcome resistance from the sheet member. A central opening is located across the central pleat and is adapted for attachment of a sleeper jacket or similar retaining type top. The infant is placed in the jacket and may sit and move somewhat freely; however, it is unable to free the sheet from the mattress or otherwise move from the central region thereof.

Other objects and features will be obvious to a person skilled in the art from the following detailed description, taken with the accompanying drawings.

DETAILED DESCRIPTION OF THE DRAWINGS

DETAILED DESCRIPTION OF THE PREFERRED EMBODIMENT

Figure 3:
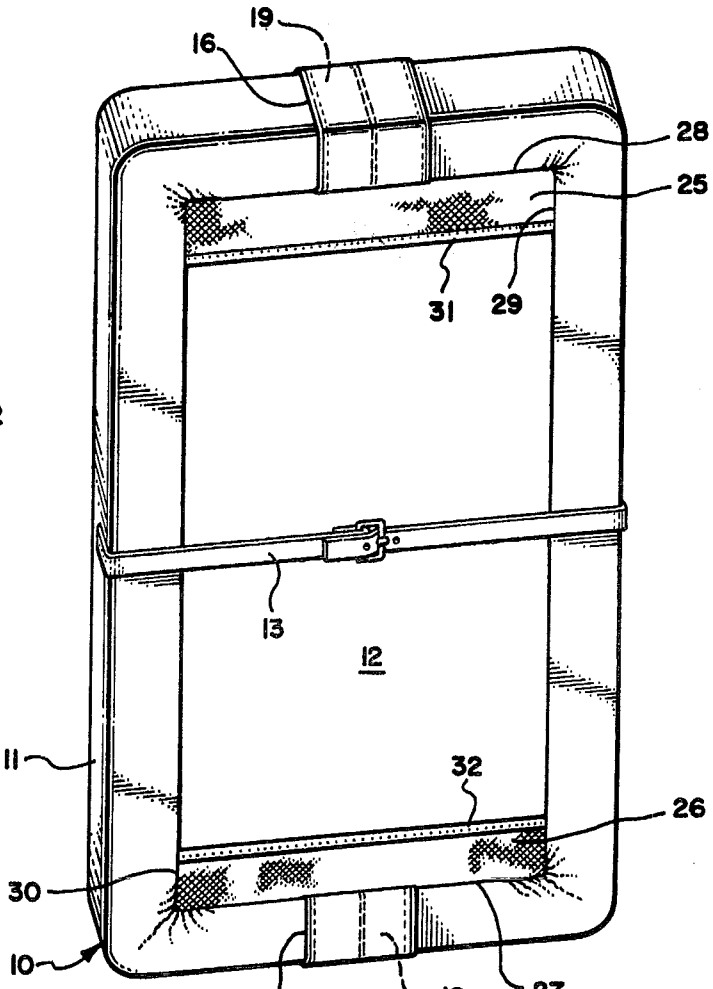
FIG. 3 is a bottom perspective view of an infant sheet likewise fitted on a mattress.
Figure 2:
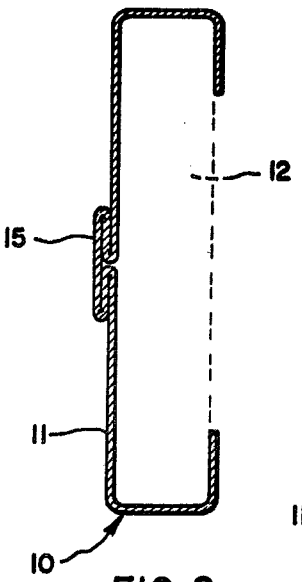
FIG. 2 is a view taken along lines 2—2 of FIG. 1.

Referring now to the drawings:

An infant sheet 10 is shown comprising a sheet member 11 which is adapted for placement on a mattress 12. The means for adapting the sheet member 11 for such placement may include a variety of techniques, the preferred being the use of a form-fitting sheet member which is elastically gathered at the corners to encase the mattress 12 as is more particularly shown in FIG. 3. Obviously other methods such as ties and bands 13 can be utilized to secure the sheet member to the mattress.

Because of structural features which will be explained hereinafter, it is important that the length of the sheet member extend beyond the length of the mattress 12 in order to insure proper tension of the sheet member thereon. Where the sheet member is both longer and wider than the mattress, it may be possible to secure the sheet member to the mattress by merely tucking the extended sides and ends under the mattress body.

A central pleat 15 is formed along the length of the sheet member 11 to incorporate a ballooning or extending capability therein. This pleat is located along a center line traversing the length of the sheet member and is fixed at the opposing ends to bias the sheet in a folded configuration. The fixation of the pleats can be accomplished by sewing the perimeters 16 and 17 at each end to the covered sheet member thereunder. When sewn over the covered portion of the sheet member 18 and 19, these end sections 16 and 17 are in nonextending form and develop the pleated configuration to the remaining central section of the sheet member extending between these fixed ends. This central pleat should be located in a central location with respect to the sides of the sheet member so that the infant which is to be placed along this central pleat is generally restricted to a central location of the mattress.

A central opening 20 is oriented across the central pleat 15 so that part of the infant's body can be placed through the opening and covered by the sheet member 11. This central opening 20 is adapted for attachment of a jacket 21. The size of the opening 20 is structured to correspond with the trunk opening 20 of the jacket 21 to facilitate full circumferential attachment thereof. This attachment totally encloses the infant and reduces air flow under the infant's cover. Means of attachment can be by any suitable method such as snaps, zipper, VELCRO, etc. Likewise, the jacket can be sewn at the central opening to make a permanent, integral unit.

Figure 1:
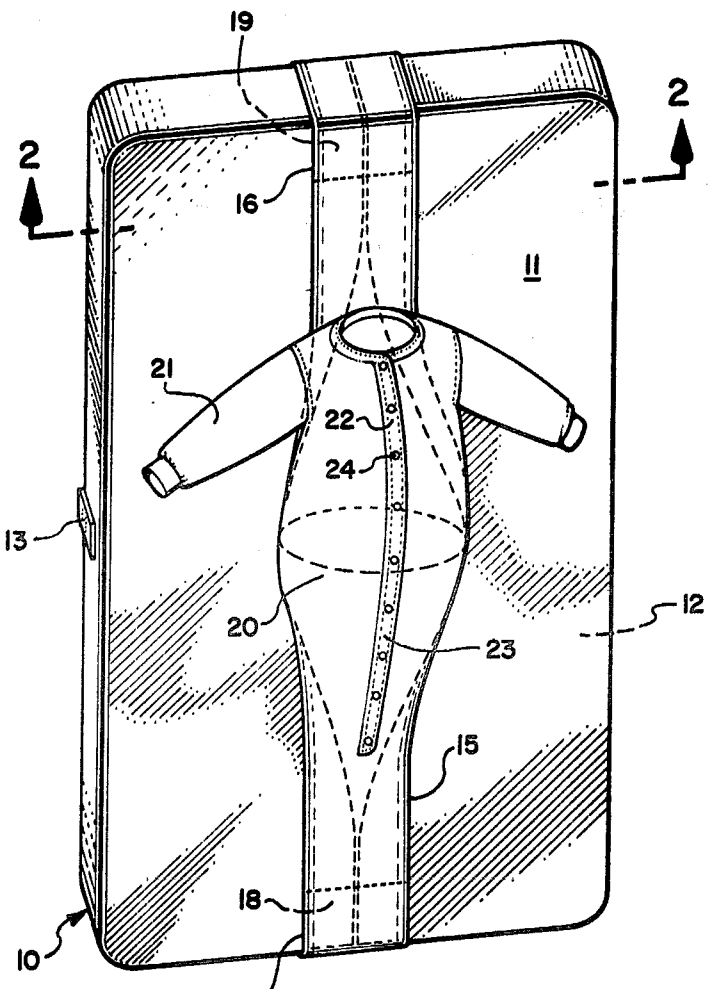
FIG. 1 is a top, perspective view of an infant sheet appropriately positioned on a mattress foundation.

As illustrated in FIG. 1, the jacket 21 has an adjustable opening 22 along its front to facilitate placement of the infant therein. Where the jacket is permanently sewn to the infant sheet, an extension of the jacket opening 23 further simplifies the positioning of an infant in the infant sheet and attached jacket. A fastening means 24 is included to permit closing of the jacket opening and should be capable of precluding the infant from opening the same.

To further secure the crib sheet to the mattress body, an anchor band 13 is attached at the sides of the sheet member and is connected under the mattress body. Additionally, the end of the sheet member can be more securely retained by use of a rectangular retaining strip 25 or 26 which is sewn or otherwise attached along the length of the sheet member end 27 or 28. The sides of the retaining strip 29 or 30 are likewise attached at sides of the sheet member to provide an integral extension of each sheet member end along the bottom surface of the mattress 12. This retaining strip can be formed of an appropriate bias material with an elastic band 31 or 32 to simplify implacement and removal.

As an illustration of construction of a subject infant sheet suitable for a standard size crib of 28 inches by 52 inches, an appropriate fabric having an approximate dimension of 54 inches wide and 68 inches long is selected. The 54 inch width allows 7 inches wrap around and undercover on each side of the mattress and an approximate 12 inch fullness to the sheet member on the mattress top. This 12 inches of fullness provides ample room so that the child can move comfortably under the sheet. The central opening 20 is cut across the central pleat 15 to an approximate length of 10 inches or thereabouts to correspond to the opening at the base of the jacket 21 to be attached thereto. The extension 23 from the jacket opening 22 is formed by cutting approximately 13 inches from the center of the opening 20 down toward one of the fixed ends 17 of the central pleat. The jacket is stitched to the opening 20 with the jacket opening 22 being aligned with the lengthwise cut 23 which forms the opening extension.

The central pleat is formed by folding the sheet member in half and sewing a seam approximately 6 inches in from the center fold and 15 inches in length parallel to the center fold. This same seam is placed in the opposing side of the sheet member and operates to define the central pleat when the sheet is folded open in a flat configuration. The sewn section of the sheet member is then opened and forms a box pleat which is sewn at each edge along the perimeter of the box 16 and 17 to fix the pleated configuration along the length of the central pleat.

Eight inch squares are cut from each corner of the sheet and the raw edges are sewn together and reinforced with 9 inches of seam binding to form a mitered corner. A form-fitting configuration is developed by sewing darts at each corner to gather in the fullness. The retaining strip is formed by sewing a bias strip at the sheet ends and sides. This extension of the sheet ends provides greater safety by precluding untimely release of the sheet from the mattress in response to movements by the infant. Utilization of bias material with appropriate elongation characteristics provides ease in emplacement and removal, and reduces the risk of tearing the sheet. Elastic can also be applied at the exposed edges 31 and 32 of the bias strip to increase tension for securing the infant sheet to the mattress.

It will be obvious to those skilled in the art that various types of structure can be utilized to implement the inventive concepts herein. The indicated dimensions are for illustration only and would be adjustable to correct the infant sheet size to conform to a particular mattress. It is therefore to be understood that the present disclosure is by way of example and that variations are possible without departing from the scope of the hereinafter claimed subject matter, which subject matter is to be regarded as the invention.

I claim:

1. An infant sheet for use with a crib or bed mattress comprising:

a sheet member having a length greater than the length of said mattress and adapted for placement thereon;

a central pleat formed in said sheet member and extending the length thereof, said pleat being fixed in nonextending form at opposing end locations which are substantially centered along the width of said sheet member;

an extendable section of said central pleat formed in said sheet member between the fixed, nonextending pleat sections at said end locations; and a central opening in said sheet member extending across said central pleat and adapted in configuration for attachment of a jacket member thereto.

2. An infant sheet as defined in claim 1, further comprising a jacket member having a trunk opening adapted for attachment at said central opening, the combined infant sheet and attached jacket forming an integral unit for retaining a infant in a central region of said mattress.

3. An infant sheet as defined in claim 2, wherein said combined sheet and jacket have an adjustable opening extending from a neck opening of said jacket into said central pleat, said adjustable opening having means for being secured in a closed configuration.

4. An infant sheet as defined in claim 1, further comprising an anchor band attached at opposing sides of said sheet and adapted for securing said sheet to said mattress.

5. An infant sheet as defined in claim 1, wherein said sheet member includes elastic means attached along the edges of sheet corners for drawing the sheet perimeter into a form-fitting configuration, biasing said perimeter to a diameter less than the fully open diameter of said sheet member.

6. An infant sheet as defined in claim 5, further comprising a substantially rectangular retaining strip fastened at a long side thereof to the end width of said sheet member and at short sides thereof to portions of each side of said sheet member, adapting said strip for positioning at a bottom surface of said mattress.

7. An infant sheet as defined in claim 6, wherein said retaining strip comprises biasing material.

8. An infant sheet as defined in claim 1, wherein the fixed ends of said pleat in nonextending form comprise box pleats.

* * * * *